US007128721B2

(12) United States Patent
Ferber et al.

(10) Patent No.: US 7,128,721 B2
(45) Date of Patent: Oct. 31, 2006

(54) PORTABLE BODY MASSAGER

(75) Inventors: Roman Ferber, West Bloomfield, MI (US); Stephen Chung, Taipei (TW)

(73) Assignee: HoMedics, Inc., Commerce Township, MI (US)

( * ) Notice: Subject to any disclaimer, the term of this patent is extended or adjusted under 35 U.S.C. 154(b) by 227 days.

(21) Appl. No.: 10/836,905

(22) Filed: Apr. 30, 2004

(65) Prior Publication Data

US 2005/0245851 A1 Nov. 3, 2005

(51) Int. Cl.
*A61H 15/00* (2006.01)

(52) U.S. Cl. ..... 601/86; 601/87; 601/98; 601/101; 601/103; 601/112

(58) Field of Classification Search ..... 601/49, 601/56–60, 84–87, 90, 91, 93, 94, 97–99, 601/100, 101, 103, 112, 113, 115, 116, 121, 601/126, 127, 133, 134, 136
See application file for complete search history.

(56) References Cited

U.S. PATENT DOCUMENTS

| | | | |
|---|---|---|---|
| 3,001,523 | A | 9/1961 | Sugimoto |
| 3,374,784 | A | 3/1968 | Brent et al. |
| 3,633,571 | A | 1/1972 | Shinagawa et al. |
| 4,167,182 | A | 9/1979 | Yamamura et al. |
| 4,373,516 | A | 2/1983 | Masuda et al. |
| 4,412,534 | A | 11/1983 | Hamabe et al. |
| 4,422,448 | A | 12/1983 | Sugai et al. |
| 4,422,449 | A | 12/1983 | Hamabe |
| 4,491,127 | A | 1/1985 | Yamamura et al. |
| 4,505,267 | A | 3/1985 | Inada |
| 4,574,786 | A | 3/1986 | Hashimoto et al. |
| 4,576,149 | A | 3/1986 | Otuka et al. |
| 4,686,967 | A | 8/1987 | Hashimoto et al. |
| 4,718,408 | A | 1/1988 | Barreiro |
| 4,777,940 | A | 10/1988 | Yamasaki |
| 4,785,798 | A | 11/1988 | Yamasaki |
| 5,020,518 | A | 6/1991 | Spears et al. |
| 5,063,911 | A | 11/1991 | Teranishi |
| 5,179,940 | A | 1/1993 | Barreiro |
| 5,183,034 | A | 2/1993 | Yamasaki et al. |
| 5,233,973 | A | 8/1993 | Gill et al. |
| 5,265,590 | A | 11/1993 | Takagi |
| 5,305,738 | A | 4/1994 | Shimizu |
| 5,356,369 | A | 10/1994 | Yamasaki et al. |
| 5,460,598 | A | 10/1995 | Yamasaki et al. |
| 5,462,516 | A | 10/1995 | Anderson |
| 5,464,382 | A | 11/1995 | Wang |

(Continued)

FOREIGN PATENT DOCUMENTS

EP 1400230 A1 3/2004

(Continued)

OTHER PUBLICATIONS

Dr. Scholl's, Look. Feel. Do. Better., 2003, Helen of Troy.

*Primary Examiner*—Quang D. Thanh
(74) *Attorney, Agent, or Firm*—Brooks Kushman P.C.

(57) ABSTRACT

The present invention discloses a body massager comprising a portable housing including a backrest and a seat support. A longitudinal guide is provided in the backrest cooperating with a carriage for translation of the carriage within the backrest and a motor drives the carriage along the guide. A pair of massage members are supported by the carriage and extend from the backrest for imparting a massage effect upon the back of the user. The seat support includes a massager therein for imparting another massage effect to the user.

28 Claims, 5 Drawing Sheets

U.S. PATENT DOCUMENTS 5,630,790 A 5/1997 Ito
5,685,827 A 11/1997 Shimizu
5,755,677 A 5/1998 Masuda et al.
5,785,668 A 7/1998 Shimizu
5,792,080 A 8/1998 Ookawa et al.
5,807,288 A 9/1998 Wu
6,056,708 A 5/2000 Sayama et al.
6,077,238 A * 6/2000 Chung ..... 601/57
6,083,180 A 7/2000 Shimizu
6,083,181 A 7/2000 Marcantoni
6,200,282 B1 3/2001 Furuie et al.
6,213,962 B1 4/2001 Shimizu
6,224,563 B1 5/2001 Nonoue et al.
6,283,928 B1 9/2001 Wang
6,312,400 B1 11/2001 Itikawa et al.
6,402,709 B1 6/2002 Wu
6,503,212 B1 1/2003 Park
6,511,448 B1 1/2003 Furuie et al.
6,517,500 B1 2/2003 Ichikawa
6,629,939 B1 10/2003 Jikiba et al.
6,656,140 B1 12/2003 Oguma et al.
6,749,577 B1 6/2004 Kume et al.
6,790,190 B1 9/2004 Marcantoni
6,805,680 B1 10/2004 Klingler
6,808,500 B1 10/2004 Cheng-Yi et al.
6,814,710 B1 11/2004 Dehli
6,832,991 B1 12/2004 Inada et al.
6,837,861 B1 1/2005 Lin
6,840,914 B1 1/2005 Takamura
6,849,054 B1 2/2005 Kim
6,866,644 B1 3/2005 Kost
6,890,313 B1 5/2005 Kim
6,899,688 B1 5/2005 Wu
6,911,012 B1 6/2005 Kahn
6,916,300 B1 7/2005 Hester et al.
2001/0011160 A1 8/2001 Oguma et al.
2002/0138023 A1 9/2002 Kume et al.
2003/0009117 A1 1/2003 Zou
2003/0018284 A1 1/2003 Lim
2003/0032903 A1 2/2003 Kasai
2003/0060741 A1 3/2003 Park
2003/0120187 A1 6/2003 Kan et al.
2003/0199796 A1 10/2003 Yamazaki et al.
2003/0212353 A1 11/2003 Kahn
2003/0212354 A1 11/2003 Kahn
2003/0216673 A1 11/2003 Miki et al.
2003/0216674 A1 11/2003 Miki et al.
2003/0225351 A1 12/2003 Wu
2004/0049136 A1 3/2004 Lin
2004/0082889 A1 4/2004 Wu
2004/0097851 A1 5/2004 Inada et al.
2004/0097854 A1 5/2004 Hester et al.
2004/0106882 A1 6/2004 Tseng
2004/0122343 A1 6/2004 Mori et al.
2004/0127823 A1 7/2004 Mori et al.
2004/0158176 A1 8/2004 Park
2004/0158180 A1 8/2004 Liang
2004/0171972 A1 9/2004 Shimizu et al.
2004/0183345 A1 9/2004 Furuie et al.
2004/0186398 A1 9/2004 Furuie
2004/0210174 A1 10/2004 Kim
2004/0211015 A1 10/2004 Chen
2004/0225240 A1 11/2004 Kim
2004/0230145 A1 11/2004 Kim
2004/0236256 A1 11/2004 Kim
2004/0243030 A1 12/2004 Tanizawa et al.
2004/0243033 A1 12/2004 Kim
2004/0243034 A1 12/2004 Kim
2004/0249321 A1 12/2004 Grueger et al.
2004/0260215 A1 12/2004 Kim
2005/0010142 A1 1/2005 Kim
2005/0010143 A1 1/2005 Kim
2005/0010144 A1 1/2005 Chen
2005/0015029 A1 1/2005 Kim
2005/0020946 A1 1/2005 Kim
2005/0033204 A1 2/2005 Nakamura et al.
2005/0049530 A1 3/2005 Kim
2005/0049531 A1 3/2005 Kim
2005/0070826 A1 3/2005 Hsiao
2005/0080365 A1 4/2005 Wu et al.
2005/0090770 A1 4/2005 Chen
2005/0090771 A1 4/2005 Miki
2005/0096571 A1 5/2005 Miki
2005/0101890 A1 5/2005 Mizoguchi et al.
2005/0124921 A1 6/2005 Tseng
2005/0137503 A1 6/2005 Hori et al.
2005/0148912 A1 7/2005 Liao
2005/0256434 A1 11/2005 Luo

FOREIGN PATENT DOCUMENTS

GB 2 123 298 A 2/1984
GB 2 267 440 A 12/1993
JP S50-86889 A 7/1975
JP S56-119251 A 9/1981
JP S59-28963 A 2/1984
JP S60-135122 U 9/1985
JP H06-209974 A 8/1994
JP H07-080035 A 3/1995
JP H10-216187 A 8/1998
JP 2000-262575 A 9/2000
JP 2001-17494 A 1/2001
JP 2001-29419 A 2/2001
JP 2001-314470 A 11/2001
JP 2001-314471 A 11/2001
JP 2002-263155 A 9/2002
JP 2003-38591 A 2/2003
WO 02069880 A1 9/2002

* cited by examiner

PORTABLE BODY MASSAGER

BACKGROUND OF THE INVENTION

1. Field of the Invention

The present invention relates to massagers, particularly to portable body massagers.

2. Background Art

The prior art includes body massagers provided within chairs, as well as in portable cushions. These prior art body massagers commonly include a track or guide for moving a massage assembly longitudinally within the chair or cushion. The prior art body massagers are relatively complex and utilize many components, thereby requiring sufficient structure to support the massager and limiting the portability of the massager. Due to the complexities of conventional body massagers, a consumer's ability to procure such massagers is limited due to value and affordability.

For example, many prior art body massagers include a complex guide system and frame thereby requiring a housing that is sufficiently robust, such as a chair. Many prior art body massagers require two motors, one for translating the massage mechanism, and the other for imparting the massage effect from the massage mechanism. Accordingly, these drawbacks of the prior art add both cost and weight to the prior art body massagers.

A goal of the present invention is to provide a simplified body massager having improvements in massage function, portability and cost in view of the prior art.

SUMMARY OF THE INVENTION

An aspect of the present invention is to provide a body massager comprising a portable housing having an external contact surface for receiving a portion of a body of a user. A longitudinal guide is mounted in the housing; and a carriage is oriented in the housing and cooperating with the guide for limited longitudinal translation. A motor is supported by the carriage or the housing for translating the carriage along the guide. A pair of massage members are supported by the carriage for rotation relative to the carriage about spaced apart axis that are perpendicular to both the longitudinal guide and transverse axis of the housing. The massage members extend out of the housing through an aperture formed through the body contacting surface for providing a massage effect to the user.

Another aspect of the present invention is to provide a portable body massager comprising a longitudinal backrest housing having an external surface sized to receive a back of a user thereon. A longitudinal guide is mounted in the backrest housing. A carriage is oriented in the backrest housing and cooperating with the guide. A motor is supported by one of the carriage and the backrest housing that is operably coupled to the other of the carriage and the backrest housing for translating the carriage along the guide. Massage members are supported by the carriage for rotation relative to the carriage, and extend out of the housing through an aperture formed to the body contacting surface for imparting a massage effect upon the back of the user as the carriage is translated relative to the backrest housing. The massage members are retractable for providing compliancy to the massage effect. A seat support housing is sized to seat the user thereon and is pivotally connected to the backrest housing at a longitudinal end of the backrest housing. A massager is oriented within the seat support housing for imparting another massage effect to the user.

The above aspects and other aspects, objects, features, and advantages of the present invention are readily apparent from the following detailed description of the preferred embodiment for carrying out the invention when taken in connection with the accompanying brief description of the drawings.

DETAILED DESCRIPTION OF THE PREFERRED EMBODIMENTS

Figure 1:
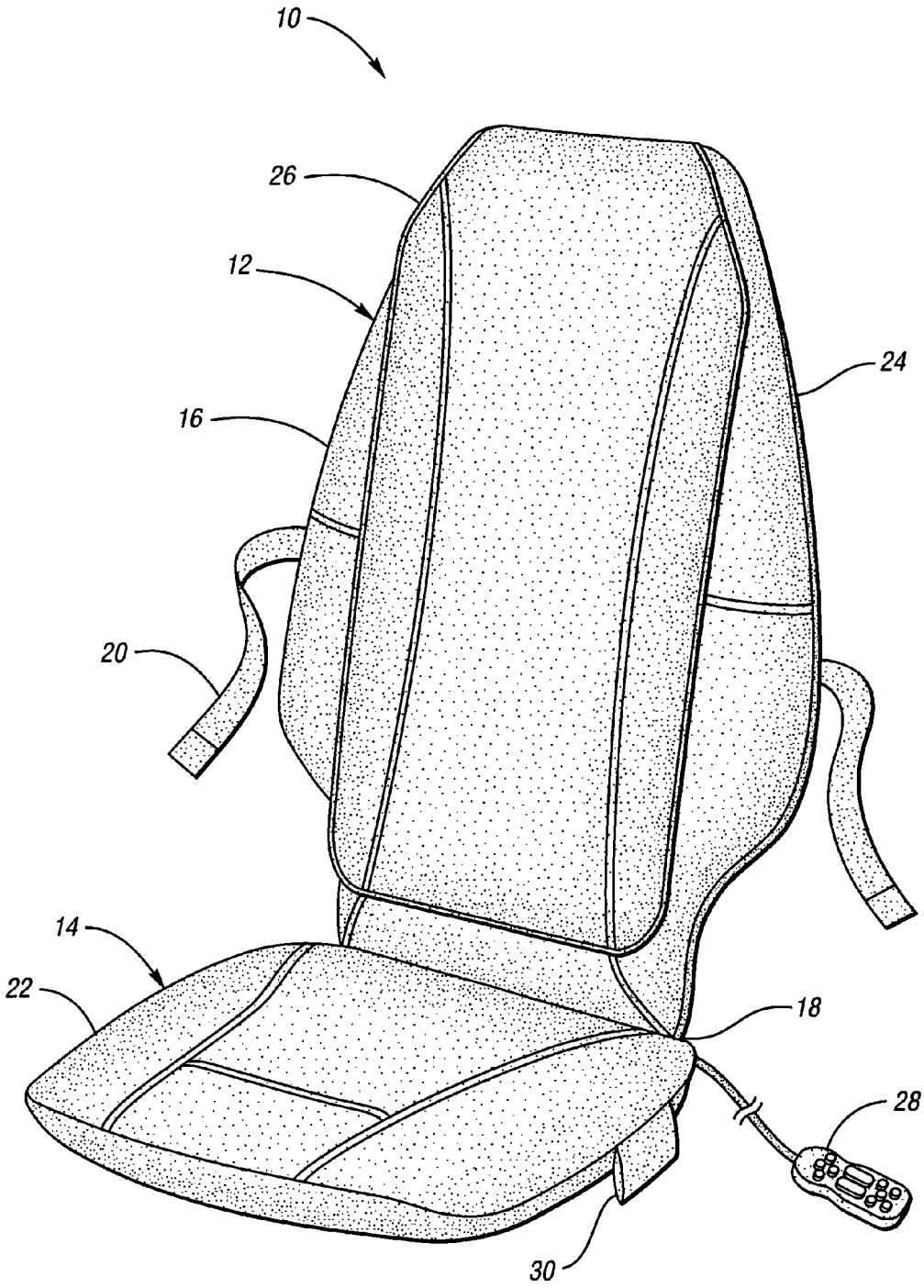
FIG. 1 is a perspective view of a preferred embodiment body massager in accordance with the present invention.

With reference to FIG. 1, a preferred embodiment body massager is illustrated in accordance with the present invention and is referenced generally by numeral 10. The body massager 10 includes a backrest region 12 and a seat support region 14. The internal assemblies of the backrest region 12 and the seat support region 14 are collectively retained within a flexible cover 16, which is formed of a high quality vinyl. Of course other materials such as leather may be employed for the cover 16. The cover 16 provides a pivotal connection 18 at a lower longitudinal end of the backrest region 12 and a rearmost end of the seat support region 14. The flexible material of the cover 16 provides a living hinge at the pivotal connection 18 permitting user adjustment of an included angle between the backrest region 12 and the seat support region 14.

Massage effects provided by the body massager 10 include a kneading massage effect provided in the backrest support 12, which is operable to provide the kneading massage effect longitudinally along the length of the backrest region 12. The seat support region 14 provides a vibratory massage effect to the user seated thereupon.

The backrest region 12 is sized to be received upon a backrest of a conventional chair. Likewise, the seat support region 14 is sized to be received upon a seat support of a conventional chair. Additionally, the body massager 10 is portable due to its compact size and light weight so that the user may place the body massager 10 upon a conventional chair for receiving a massage when seated upon the chair. The adjustability of the included angle between the backrest region 12 and the seat support region 14 accommodates a wide range of angles that may be incorporated in conventional chairs.

The backrest region 12 includes a height and width corresponding to the conventional chair and has a thickness that is adequate for housing the massager assembly therein while avoiding disruption of comfort and support provided by the underlying chair. Likewise, the seat support region 14 has a width and a depth corresponding to that of the conventional seat support and has a thickness that is adequate for housing the associated massager assembly while avoiding disruption of comfort and support provided by the underlying chair. Additionally, the backrest region 12 includes a pair of straps 20 mounted from its lateral sides for securing the body massager 10 to the conventional chair. The straps 20 each include one of a hook and loop material for securing the straps 20 about the backrest of the conventional chair. Of course, any engagement mechanism is contemplated, such as a belt buckle, a clip or the like.

By way of example, the backrest region 12 has a height of approximately twenty-five inches, an overall width of approximately eighteen inches, and a thickness of approximately two and a half inches. Also, by way of example, the seat support region 14 has a width of approximately sixteen and a half inches, a depth of approximately fourteen and a half inches, and a thickness of approximately one and three quarter inches. Of course, the invention contemplates that the body massager may have dimensions adequate to be received by any conventional chair. However, the dimensions of the preferred embodiment are suitable for most conventional chairs.

The seat support region 14 includes a seating surface 22 provided thereon for receiving the user when seated. The backrest region 12 includes a backrest surface 24 for receiving and supporting the back of the user thereupon. The massage assemblies of the backrest region 12 and the seat support region 14 impart the respective massage effects through the backrest surface 24 and seating surface 22 respectively. The cover 16 includes a removable flap 26 mounted to the backrest region 12 along the backrest surface 24. The flap 26 is removably attached by hook and loop material so that the user may remove the flap 26 and expose a woven fabric (not shown). The flexible material of the flap 26 includes dampening characteristics which reduce the massage effect imparted to the backrest surface 24. Accordingly, the user may remove the flap 26 to increase the massage intensity.

The body massager further includes a remote 28 connected thereto for controlling the operations of the massager 10. The cover 16 has a pocket 30 mounted to a lateral side of the seat support region 14. The pocket 30 has an opening provided in its rearward end so that the remote 28 may be conveniently retained when not in use.

Figure 2:
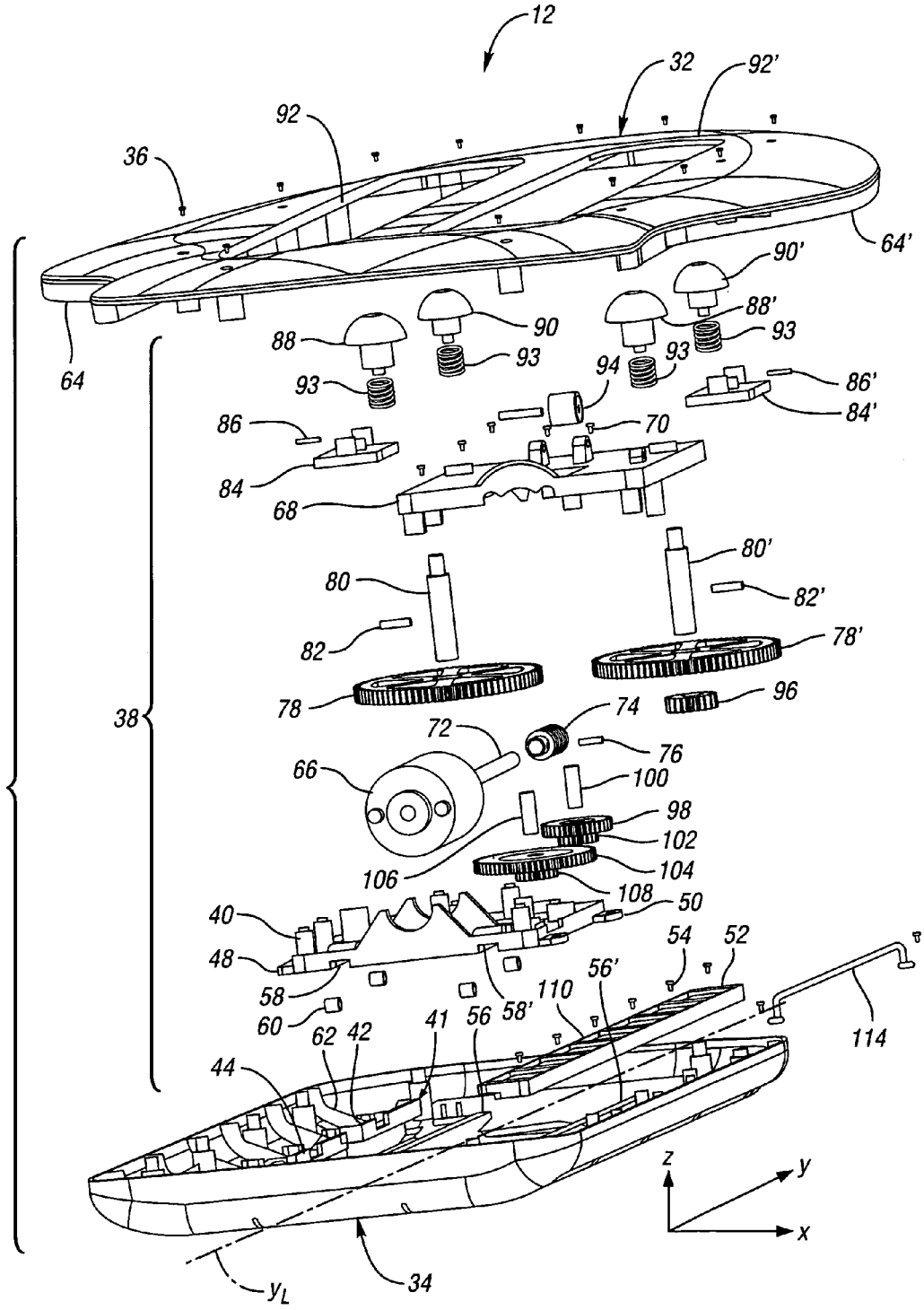
FIG. 2 is an exploded perspective view of a backrest region of the body massager of FIG. 1.
Figure 3:
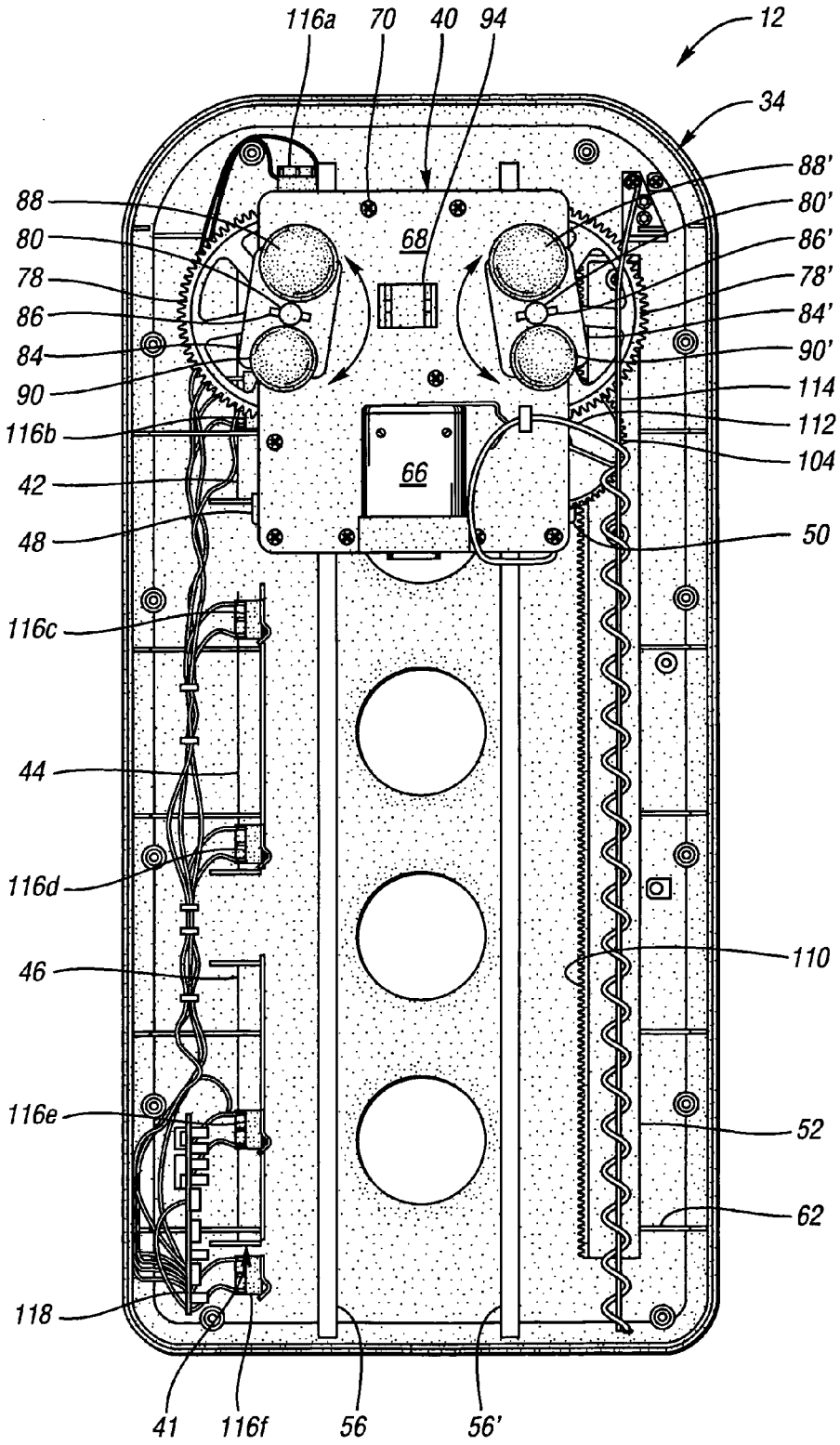
FIG. 3 is a front side elevation view of the backrest region of the body massager of FIG. 1, illustrated with a portion of a housing thereof partially removed.
Figure 4:
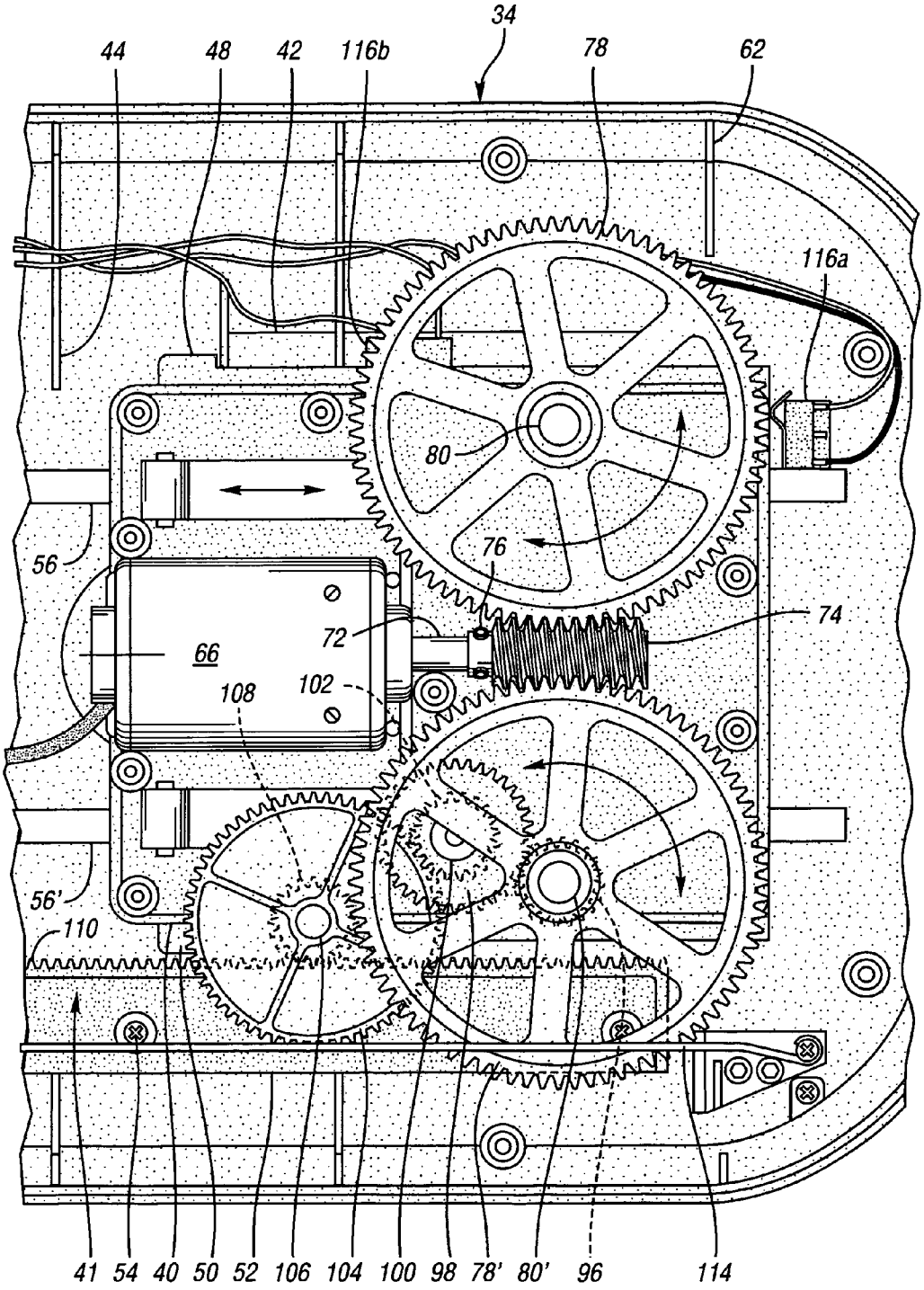
FIG. 4 is an enlarged, front side elevation view of a carriage of the body massager of FIG. 1, illustrated within the backrest housing of the body massager with a cover plate removed therefrom.

With reference now to FIGS. 2–4, the backrest region 12 is illustrated in greater detail. The backrest region 12 includes a two piece housing provided by an upper housing portion 32 and a lower housing portion 34. The upper housing portion 32 and the lower housing portion 34 are sized and adaptable to be secured together by a plurality of fasteners 36 for retaining components of a massager assembly 38 therein. The massage assembly 38 includes a carriage 40 which cooperates with the lower housing portion 34 for limited longitudinal translation within the backrest region 12. Accordingly, the lower housing portion 34 includes a longitudinal guide 41 mounted therein for cooperating with the carriage 40. The longitudinal direction y is illustrated in FIG. 2 and the housing includes a longitudinal axis $y_L$. The guide 41 includes a series of gibs indicated and referenced as upper gib 42, central gib 44 and lower gib 46. The gibs, 42, 44, 46 of the lower housing portion 34 cooperate with and retain a first longitudinal key 48 formed laterally along the carriage 40. The carriage 40 includes a second longitudinal key 50 formed laterally thereupon in transversely spaced opposition to that of the first key 48. A transverse direction x is illustrated in FIG. 2. The second key 50 is retained relative to the lower housing portion 34 by an elongate retainer gib 52 which is secured to the lower housing portion 34 by a series of fasteners 54.

The guide 41 of the lower housing portion 34 further comprises a pair of longitudinal rails 56, 56' provided within the lower housing portion 34 and extending upward therefrom. A pair of keyways 58, 58' are formed longitudinally through the carriage 40. The keyways 58,58' are sized to receive the rails 56, 56', respectively. The cooperation of the rails 56, 56' and keyways 58, 58' provides transverse guidance and support to the carriage 40 as it translates along the guide 41. The carriage 40 includes a plurality of roller bearings 60, which are each pivotally connected to the carriage 48 and are offset from the keyways 58, 58' and adjacent thereto for engaging a bearing surface provide upon each rail 56, 56'. As the carriage 40 translates along the guide 41, the carriage 40 is bearingly supported by the roller bearings 60 as they engage the surfaces provided by the rails 56, 56'.

The lower housing portion 34 includes a series of ribs 62 formed therein for providing cross support to the lower housing portion 34 and the gibs 42, 44, 46, 52. Accordingly, the two piece housing 32, 34 provides both a housing and a structural frame for the massager assembly 38. Both housing portions 32, 34 are each formed from an injection molding process or the like to provide low weight, yet rigid structural members. Additionally, the upper gib 42, central gib 44, lower gib 46 and rails 56, 56' are integrally formed with the lower housing portion 34 thereby enhancing rigidity and structural cooperation therebetween and minimizing costs in components and assembly.

The upper housing portion 32 has a peripheral contour that exceeds the overall dimensions of the lower housing portion 34. This feature is to provide broad lateral support to the user that is distributed directly to the lower housing portion 34. A pair of lateral cushions 64, 64' are each adhered to lateral undersides of the upper housing portion 32 to provide an overall thickness of the two piece housing that is generally uniform. Additionally, another cushion (not shown) is provided within the cover 16 and attached therein. The cushion is oriented to engage the top side of the upper housing portion 32 about its periphery for providing padded comfort and support to the user as the user rests its back against the backrest surface 24. The cushion is provided within the cover 16 rather than being adhered atop the upper housing portion 32 to permit access to the fasteners 36 that fasten the housing portions 32, 34 together.

The massage assembly 38 includes a motor 66, which is mounted to the carriage 40 and retained by a cover plate 68. The cover plate 68 and the carriage 40 collectively define a motor mount for the motor 66 and are fastened together by a plurality of fasteners 70. The motor 66 is operable to impart a massage effect from the massage assembly 38 and translate the carriage 40 along the guide 41 of the lower housing portion 34. The motor 66 includes a motor output shaft 72 extending from the motor 66 and driven thereby. A worm 74 is provided on the motor output shaft 72 and fixed relative to the shaft by a fastener 76. The worm 74 drives a pair of worm gears 78, 78' in opposed rotational directions. Each worm gear 78, 78' is secured to a gear shaft 80, 80' by a fastener 82, 82'. The gear shafts 80, 80' are each rotatably connected to the carriage 40 and the cover plate 68 so that the worm 74 drives the worm gear 78, 78' in opposite rotary directions relative one another in a reduced rotation from that of the motor 66. The gear shafts 80, 80' extend in direction z, which is perpendicular to both the longitudinal direction y and the transverse direction x.

Each gear shaft 80, 80' extends through the cover plate 68 and receives a massage bracket 84, 84', which are each fastened to the respective gear shaft 80, 80' by a fastener 86, 86'. The massage brackets 84, 84' are transversley spaced about the longitudinal axis $y_L$. Each massage bracket 84, 84' includes a first massage hemispherical node 88, 88' and a second hemispherical massage node 90, 90' mounted to the respective bracket.

The gear shafts 80, 80' are oriented perpendicular to the guide 41 and extend in the z direction towards the backrest surface 24. The massage nodes 88, 88', 90, 90' each rotate relative to the respective massage bracket 84, 84' about an axis that is offset from that of the respective gear shaft 80, 80'. The massage nodes 88, 88', 90, 90' extend through a corresponding aperture 92, 92' formed through the housing upper portion 32 for imparting the massage effect to the user through the cover 16. As the massage nodes 88, 88', 90, 90' revolve around the corresponding gear shaft 80, 80' a rotary kneading massage effect is imparted upon the user, which is commonly referred to as a Shiatsu massage.

Each massage node 88, 88', 90, 90' is rotatably connected to the corresponding massage bracket 84, 84' to reduce friction generated in the rotary kneading massage effect. Further, each massage node 88, 88', 90, 90' is axially translatable relative to the corresponding massage bracket 84, 84' and is urged to an extended position in the z direction by a spring 93 (FIG. 2) retained between the corresponding massage node 88, 88', 90, 90' and the respective massage bracket 84, 84'. The springs cause the massage nodes 88, 88', 90, 90' to extend and engage the user, yet permit the respective massage node 88, 88', 90, 90' to be urged to a retracted position upon a load provided by the user resting thereagainst thereby enhancing the kneading massage effect by adding axial compliancy to the operation of the rotary massage effect.

Additionally, the first massage nodes 88, 88' have an overall height in the z direction greater than that of the second massage nodes 90, 90' to extend further from the corresponding massage brackets 84, 84'. The first massage nodes 88, 88' also have a diameter greater than that of the second massage nodes 90, 90'. These variations are utilized for varying the engagement of the rotary kneading effect with the user, resulting in a kneading effect that is nonsymmetrical and similar to a massage provided by the hands of a skilled massage therapist.

The apertures 92, 92' formed through the upper housing portion 32 are generally elongate for permitting the massage nodes 88, 88', 90, 90' to pass therethrough as the carriage 40 is translated relative to the guide 41. Further, the cover plate 68 includes a roller bearing 94 pivotally connected thereto for engaging an underside bearing surface formed within the upper housing portion 32, thus providing bearing support between the carriage 40 and the upper housing portion 32. Accordingly, loading imparted upon the backrest surface 24 is translated through the upper housing portion 32 to the carriage 40 through roller bearing 94, to the lower housing portion 34 through the roller bearings 60 for providing bearing support therebetween and preventing such loading from inhibiting the translation of the carriage 40 along the guide 41.

A first pinion gear 96 is mounted upon gear shaft 80' between the worm gear 78' and the carriage 40 for being driven by rotation imparted upon the worm gear 78'. A first reduction gear 98 is rotatably mounted upon an intermediate shaft 100 that is supported by the carriage 40 for rotation about an axis in the z direction. A second pinion gear 102 is secured to the first reduction gear 98 and driven by the rotation imparted upon the first reduction gear 98. The second pinion gear 102 is engaged with a second reduction gear 104. The second reduction gear 104 is rotatably coupled to the carriage 40 about a shaft 106, which is supported between the carriage 40 and the cover plate 68 for rotation about an axis in the z direction. A third pinion gear 108 is secured to the second reduction gear 104 and oriented about the shaft 106 between the second reduction gear 104 and the carriage 40. The third pinion gear 108 is engaged to a gear rack 110 formed along the retainer gib 52.

The worm 74, worm gear 78', first pinion gear 96, first reduction gear 98, second pinion gear 102, second reduction gear 104, third pinion gear 108 and gear rack 110 provide a transmission such that rotation from the motor output shaft 72 experiences three stages of reduction for reduced rotation of the third pinion gear 108 relative to the motor output shaft 72 and two stages of reduction relative to the massage nodes 88, 88', 90, 90'. Since the rack 110 is fixed relative to the guide 41, rotation of the third pinion 108 translates the carriage 40 along the guide 41. Accordingly, the rotation of the motor output shaft 72 results in both a rotary kneading massage effect and translation of the carriage along the guide due to the engagement with the gear rack 110.

Due to the translation of the carriage 40 and the motor 66, cord management is necessary to ensure that a power cord 112, which provides power to the motor 66 does not interfere with, nor get damaged by the operations of the massage assembly 38. Accordingly, a longitudinal bar 114 is provided within the backrest region 12 mounted to the lower housing portion 34. The power cord 112 is coiled about the bar 114 for extension and retraction thereabout as the carriage 40 is translated along the guide 41.

The motor 66 is directly coupled to the associated transmission for translation of the carriage 40 when the motor 66 is powered. In order to reverse direction of the carriage 40, the rotational direction of the motor 66 is reversed as well. In order to control the reversal of power to the motor 66, a series of limit switches 116*a*–116*f* are provided along the guide 41. Each limit switch 116*a*–116*f* includes a leaf spring which extends in an unloaded position thereof. Upon actuation of each leaf spring, the respective limit switch 116*a*–116*f* sends a signal indicating the actuation. Accordingly, the limit switches 116*a*–116*f* are each oriented so that the associated leaf spring extends into the path of travel of the carriage 40 for actuation thereby. The signals provided by the limit switches 116*a*–116*f* are processed by a central processing unit provided at a circuit board 118, mounted within the backrest region 12 to the lower housing portion 34 as illustrated in FIG. 3.

The user operates the remote 28 to select a desired target range of massage to be imparted to the user's back. The range selected on the remote 28 is processed so that a pair of limit switches 116*a*–116*f* provide the range of travel of the carriage 40. For example, if the user selects a range of massage associated with the entire back, the limit switches 116*a*–116*f* control this operation. For example, referring to FIG. 3, with the carriage 40 in a position which actuates the limit switch 116*a*, the motor 66 begins a rotation which provides a rotary kneading massage effect rotating the massage nodes 88, 88', 90, 90' and translates the carriage 40 along the guide 41 towards the limit switch 116*f*. Upon the carriage 40 actuating the limit switch 116*f*, a signal is sent to the central processing unit, which consequently reverses the rotation of the motor 66. The reversed rotation of the motor 66 provides a reversed rotation of the rotary kneading massage and translates the carriage 40 towards the limit switch 116*a*.

Various ranges of massages are provided by the series of limit switches 116*a*–116*f* so that the user may target desired regions of massage upon the back of the user.

In order to simplify the manufacture of the backrest region 12, the limit switches 116*a*–116*f* are each adhered to the housing lower region 34 by resistance welding, friction welding, adhesives or the like.

Briefly, the kneading massage effect is generated from the simplified massage assembly 38 and corresponding support frame and guide 41. Accordingly, the kneading massage effect is provided within the body massager 10 without limiting the portability and weight of the massager 10. Additionally, the motor 66 is provided upon the carriage 40 to overcome short comings of prior art kneading massagers that require either two motors to provide both a massage effect and translation of the massage effect or a complex drive system for providing both effects, which commonly requires a heavy duty frame for supporting the complex drive system.

Figure 5:
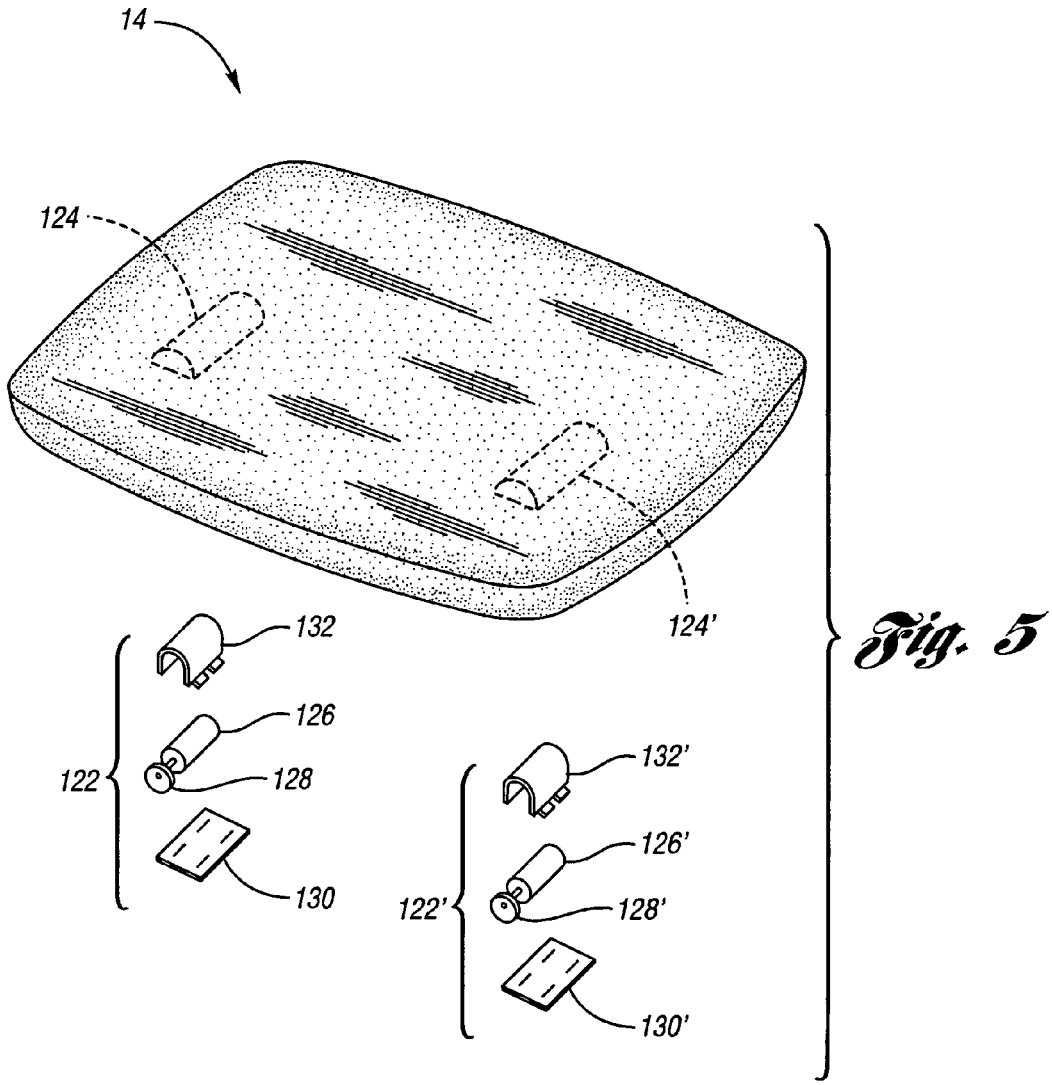
FIG. 5 is an exploded perspective view of a seat support region of the body massager of FIG. 1.

Referring now to FIG. 5, the seat support region 14 is illustrated without the cover 16 and is partially exploded. The seat support region 14 comprises a seat support housing defined by a unitary cushion 120 for providing comfort and resilient support to the user. The cushion 120 includes a pair of vibratory massage assemblies 122, 122' housed therein. The cushion 120 has a pair of recesses 124, 124' formed in its underside illustrated in hidden for receiving each of the respective vibratory massage assemblies 122, 122'. Each vibratory massage assembly 122, 122' includes a motor 126, 126' for imparting rotary motion to an eccentric weight 128, 128' for generating an invigorating vibratory massage effect upon the cushion 120, which is received by the user seated thereupon. The vibratory massage assemblies 122, 122' are spaced transversely apart relative one another to distribute the massage effect upon the cushion 120.

Each vibratory massage assembly 122, 122' includes a bracket 130, 130' for securing the respective assembly to the underside of the cushion. Specifically, each bracket 130, 130' may be adhered to the underside of the cushion 120 by an adhesive. Each vibratory massage assembly 122, 122' includes a motor mount bracket 132, 132' for securing the respective motor 126, 126' to the corresponding bracket 130, 130'.

The operation of the vibratory massage assemblies 122, 122' is controlled by the remote 28. Therefore, the vibratory massage effect may be imparted to the user alone or in combination with the rotary kneading massage effect. By way of example, the operation of the vibratory massage assemblies 122, 122' includes a steady massage, wherein both vibratory massage assemblies 122, 122' provide a consistent vibratory massage effect to the user. Additionally, a tapping massage effect is provided wherein both vibratory massage assemblies are operated synchronously with a common direction of rotation relative to another so that the user experiences a vibratory massage effect that is generally enhanced rather than merely vibrating. Additionally, a side to side vibratory massage effect is provided wherein each vibratory massage assembly 122, 122' cycles alternatingly so that the user experiences a vibratory massage effect that is directed from one of the vibratory massage assemblies 122 to the other 122'. The remote 28 provides control of the intensity of the vibratory massage effect such as low, medium and high wherein the intensity is a result of the speed of the motors 126, 126'.

In summary, the body massager 10 provides an efficient, portable, lightweight, sturdy massage apparatus which generates two types of massage to two areas of the body with operational variations thereof so that the user may experience a variety of massage effects or a desired targeted massage effect, while minimizing the costs of the overall massager.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A portable body massager sized to be received and supported by a conventional chair, the massager comprising:

a portable housing sized to be received and supported by a backrest of the conventional chair, the housing having a longitudinal axis and an external contact surface for receiving a portion of a body of a user;

a longitudinal guide mounted in the housing;

a carriage oriented in the housing and cooperating with the guide for limited longitudinal translation in the housing along the guide;

a motor supported upon the carriage, the motor having a motor output shaft driven thereby, the motor output shaft being operably coupled to the housing to translate the carriage along the guide; and at least a pair of massage members transversely spaced about the longitudinal axis, each of the at least a pair of massage members being supported by the carriage for rotation relative to the carriage about an axis that is generally perpendicular to both the longitudinal axis of the housing and a transverse axis of the housing, the massage member axes being transversely spaced apart for providing a kneading massage effect, the at least a pair of massage members extending out of the housing through an aperture formed through the body contacting surface for imparting the massage effect upon the portion of the user's body as the carriage is translated relative to the housing.

2. The portable body massager of claim 1 wherein the at least a pair of massage members are each operably driven by the motor output shaft for rotation relative to the carriage to impart a rotary kneading massage effect to the user.

3. The portable body massager of claim 1 wherein the carriage further comprises at least one roller bearing pivotally supported thereby for engaging a bearing surface provided within an underside of the external contact surface of the housing for providing bearing support therebetween as the carriage is translated within the housing.

4. The portable body massager of claim 1 wherein the housing provides a structural frame for the guide.

5. The portable body massager of claim 1 further comprising at least a pair of limit switches oriented within the housing to be actuated by the carriage at positions along the guide for providing a signal that causes the motor to reverse rotation, consequently reversing the translation of the carriage along the guide, wherein the limit switches are each adhered to the housing.

6. The portable body massager of claim 1 further comprising:

a central processing unit for programming various operations of the massager; and a series of limit switches oriented within the housing to be actuated by the carriage at spaced apart positions along the guide for providing a signal to the central processing unit whereby the user may select a desired range of targeted massage corresponding to any two of the series of limit switches so that the signal from each of the two of the series of limit switches causes the central processing unit to reverse the rotation of the motor, consequently reversing the translation of the carriage along the guide.

7. The portable body massager of claim 1 wherein at least a portion of the guide is formed integrally with the housing by a plastic injection molding process.

8. The portable body massager of claim 1 further comprising a multistage transmission driven by the motor and cooperating with the housing for the translating the carriage along the guide, wherein at least one gear of the multistage transmission rotates about an axis that is generally perpendicular to both the longitudinal axis of the housing and a transverse axis of the housing.

9. The portable body massager of claim 1 wherein each of the at least a pair of massage members further comprises at least one massage node that is not coaxial with the axis of rotation of the massage member.

10. The portable body massager of claim 1 wherein each of the at least a pair of massage members further comprises at least one massage node that is axially translatable relative to the carriage between an extended position and a retracted position.

11. The portable body massager of claim 10 wherein each massage member further comprises a spring for biasing the at least one massage node towards the extended position.

12. The portable body massager of claim 1 wherein each of the at least a pair of massage members further comprises at least two massage nodes that are not coaxial with an axis of rotation of the massage member.

13. The portable body massager of claim 12 wherein one of the at least two massage nodes extends from the carriage further than the other of the at least two massage nodes.

14. A body massager comprising:

a housing having an external contact surface for receiving a portion of a body of a user;

a longitudinal guide mounted in the housing;

a carriage oriented in the housing and cooperating with the guide for limited longitudinal translation in the housing along the guide;

a motor supported upon the carriage, the motor having a motor output shaft driven thereby;

at least a pair of massage members each supported by the carriage for rotation relative to the carriage and extending out of the housing through an aperture formed through the body contacting surface, each massage member being operably connected to and driven by the motor output shaft for providing a rotary massage effect to the user;

a pinion gear rotatably mounted to the carriage and operably driven by the motor output shaft;

a longitudinal rack affixed to the housing engaged with the pinion gear such that rotation of the pinion gear translates the carriage along the guide;

at least a pair of limit switches oriented within the housing to be actuated by the carriage at positions along the guide for providing a signal that causes the motor to reverse rotation, consequently reversing the translation of the carriage along the guide;

a worm mounted to and driven by the motor output shaft; and at least a pair of worm gears each coupled to one of the at least a pair of massage members for imparting rotation from the motor output shaft to the at least a pair of massage members;

wherein the pinion sear is driven by the worm or the pinion gear is driven by one of the at least a pair of worm gears for translating the carriage along the guide.

15. The body massager of claim 14 further comprising a central processing unit for programming various operations of the massager;

wherein the at least a pair of limit switches further comprises a series of limit switches oriented within the housing to be actuated by the carriage at spaced apart positions along the guide for providing a signal to the central processing unit whereby the user may select a desired range of targeted massage corresponding to any two of the series of limit switches so that the signal from each of the two of the series of limit switches causes the central processing unit to reverse the rotation of the motor, consequently reversing the translation of the carriage along the guide.

16. The body massager of claim 14 wherein the housing is further defined as a portable housing that is sized to be received and supported by a backrest of a conventional chair.

17. A portable body massager comprising:

a longitudinal backrest housing having an external surface sized to receive a back of a user rested thereon;

a longitudinal guide mounted in the backrest housing;

a carriage oriented in the backrest housing and cooperating with the guide for limited longitudinal translation in the backrest housing along the guide;

a motor supported by one of the carriage and the backrest housing, the motor having a motor output shaft driven thereby, the motor output shaft being operably coupled to the other of the carriage and the backrest housing to translate the carriage along the guide;

at least a pair of massage members each supported by the carriage for rotation relative to the carriage and extending out of the housing through an aperture formed through the body contacting surface for imparting a massage effect upon the back of the user as the carriage is translated relative to the backrest housing, each of the at least a pair of massage members being retractable relative to the housing for providing compliancy to the massage effect upon receipt of the back of the user;

a seat support housing sized to seat the user thereon, the seat support housing being pivotally connected to the backrest housing at a longitudinal end of the backrest housing, the pivotal connection being generally transverse relative to the backrest housing for permitting user adjustment of an included angle between the backrest housing and the seat support housing; and at least one massager oriented within the seat support housing for imparting another massage effect to the user seated thereon.

18. The portable body massager of claim 17 wherein the backrest housing further comprises a cushion affixed upon the backrest housing external surface for providing resilient support to the back of the user and the seat support housing further comprises a flexible seat cover having a seat cushion retained therein.

19. The portable body massager of claim 17 wherein the pivotal connection of the seat support housing and the backrest housing is provided by flexible material connected to a cover of the seat support housing and a cover of the backrest housing.

20. The portable body massager of claim 17 wherein the backrest housing is sized to be received and supported by a backrest of a conventional chair and the seat support housing is sized to be received and supported by a seat support of the conventional chair.

21. The portable body massager of claim 17 wherein the seat support massager further comprises at least one vibratory massager.

22. A portable body massager sized to be received and supported by a conventional chair, the massager comprising:

a portable housing sized to be received and supported by a backrest of the conventional chair, the housing having a longitudinal axis and an external contact surface for receiving a portion of a body of a user;

a longitudinal guide mounted in the housing;

a carriage oriented in the housing and cooperating with the guide for limited longitudinal translation in the housing along the guide;

a motor supported upon the carriage, the motor having a motor output shaft driven thereby, the motor output shaft being operably coupled to the housing to translate the carriage along the guide; and at least a pair of massage members transversely spaced about the longitudinal axis, each of the at least a pair of massage members being supported by the carriage for rotation relative to the carriage for imparting a massage effect upon the portion of the user's body as the carriage is translated relative to the housing, each of the at least a pair of massage members having a bracket rotatably mounted to the carriage, a primary massage node rotatably mounted to the bracket about an axis of rotation that is not coaxial with an axis of rotation of the bracket, so that the primary massage node can rotate relative to the bracket to provide a rolling massage effect, and a secondary massage node rotatably mounted to the bracket about an axis of rotation that is not coaxial with the axis of rotation of the bracket and the axis of rotation of the primary massage node, so that the secondary massage node can rotate relative to the bracket to provide a rolling massage effect;

wherein a width between the at least a pair of massage members relative to the longitudinal axis is adjustable by rotation of the at least a pair of massage members relative to the carriage.

23. The portable body massager of claim 22 wherein the operation of the motor further comprises user-selected rotation of the motor output shaft for consequently translating the carriage to a desired longitudinal orientation.

24. The portable body massager of claim 22 wherein the operation of the motor further comprises continuous rotation of the motor output shaft within a range of translation of the carriage along the guide for providing a massage effect from the at least a pair of massage members.

25. The portable body massager of claim 24 wherein the operation of the motor is controlled from a control pad.

26. A portable body massager sized to be received and supported by a conventional chair, the massager comprising:

a portable housing sized to be received and supported by a backrest of the conventional chair, the housing having a longitudinal axis and an external contact surface for receiving a portion of a body of a user;

a longitudinal guide mounted in the housing;

a carriage oriented in the housing and cooperating with the guide for limited longitudinal translation in the housing along the guide;

a motor supported upon the carriage, the motor having a motor output shaft driven thereby, the motor output shaft being operably coupled to the housing to translate the carriage along the guide; and at least a pair of massage members transversely spaced about the longitudinal axis, each of the at least a pair of massage members being supported by the carriage for rotation relative to the carriage, the at least a pair of massage members extending out of the housing through an aperture formed through the body contacting surface for imparting a massage effect upon the portion of the user's body as the carriage is translated relative to the housing;

wherein each of the at least a pair of massage members further comprises at least two massage nodes that are not coaxial with an axis of rotation of the massage member, one of the at least two massage nodes extends from the carriage further than the other of the at least two massage nodes, each massage node is axially translatable relative to the carriage between an extended position and a retracted position and each massage member further comprises a spring for biasing the at least two massage nodes towards the extended position.

27. A portable body massager sized to be received and supported by a conventional chair, the massager comprising:

a portable housing sized to be received and supported by a backrest of the conventional chair, the housing having a longitudinal axis and an external contact surface for receiving a portion of a body of a user;

a longitudinal guide mounted in the housing;

a carriage oriented in the housing and cooperating with the guide for limited longitudinal translation in the housing along the guide;

a motor supported upon the carriage, the motor having a motor output shaft driven thereby, the motor output shaft being operably coupled to the housing to translate the carriage along the guide;

at least a pair of massage members transversely spaced about the longitudinal axis, each of the at least a pair of massage members being supported by the carriage for rotation relative to the carriage, the at least a pair of massage members extending out of the housing through an aperture formed through the body contacting surface for imparting a massage effect upon the portion of the user's body as the carriage is translated relative to the housing;

a worm mounted to and driven by the motor output shaft;

at least a pair of worm gears each coupled to one of the at least two massage members for imparting rotation from the motor output shaft to the at least two massage members for providing a rotary massage effect to the user;

a pinion gear rotatably mounted to the carriage and operably driven by one of the worm or the at least a pair of worm gears; and a longitudinal rack affixed to the housing and engaged with the pinion gear such that rotation of the pinion gear translates the carriage along the guide.

28. A portable body massager sized to be received and supported by a conventional chair, the massager comprising:

a portable housing sized to be received and supported by a backrest of the conventional chair, the housing having a longitudinal axis and an external contact surface for receiving a portion of a body of a user;

a longitudinal guide mounted in the housing;

a carriage oriented in the housing and cooperating with the guide for limited longitudinal translation in the housing along the guide;

a motor supported upon the carriage, the motor having a motor output shaft driven thereby, the motor output shaft being operably coupled to the housing to translate the carriage along the guide; and at least a pair of massage members transversely spaced about the longitudinal axis, each of the at least a pair of massage members being supported by the carriage for rotation relative to the carriage for imparting a massage effect upon the portion of the user's body as the carriage is translated relative to the housing;

wherein a width between the at least a pair of massage members relative to the longitudinal axis is adjustable by rotation of the at least a pair of massage members relative to the carriage; and wherein each of the at least a pair of massage members further comprises:

a bracket rotatably mounted to the carriage, a primary massage node rotatably mounted to the bracket about an axis of rotation that is not coaxial with an axis of rotation of the bracket, so that the primary massage node can rotate relative to the bracket to provide a rolling massage effect, and a secondary massage node rotatably mounted to the bracket about an axis of rotation that is not coaxial with the axis of rotation of the bracket and the axis of rotation of the primary massage node, so that the secondary massage node can rotate relative to the bracket to provide a rolling massage effect, the secondary massage node being smaller than the primary massage node so that the rolling massage effect of the secondary massage node differs from that of the primary massage node.

* * * * *

UNITED STATES PATENT AND TRADEMARK OFFICE

CERTIFICATE OF CORRECTION

PATENT NO. : 7,128,721 B2
APPLICATION NO. : 10/836905
DATED : October 31, 2006
INVENTOR(S) : Roman Ferber It is certified that error appears in the above-identified patent and that said Letters Patent is hereby corrected as shown below:

Column 10, Line 1, Claim 14:

Delete "sear" and insert therefor -- gear --

Signed and Sealed this

Ninth Day of January, 2007

JON W. DUDAS
*Director of the United States Patent and Trademark Office*